United States Patent [19]

Kleefeldt et al.

[11] Patent Number: 4,733,892

[45] Date of Patent: Mar. 29, 1988

[54] KEEPER FOR VEHICLE DOOR LATCH AND METHOD OF MAKING SAME

[75] Inventors: Frank Kleefeldt, Heiligenhaus; Kurt Raffelsiefer, Velbert, both of Fed. Rep. of Germany

[73] Assignee: Kiekert GmbH & Co. Kommanditgesellschaft, Heiligenhaus, Fed. Rep. of Germany

[21] Appl. No.: 72,055

[22] Filed: Jul. 10, 1987

[30] Foreign Application Priority Data

Jul. 11, 1986 [DE] Fed. Rep. of Germany ..... 3623311

[51] Int. Cl.[4] ..... E05C 3/26

[52] U.S. Cl. ..... 292/216; 292/341.12; 292/DIG. 38

[58] Field of Search ..... 292/213, 216, 340, 341.12, 292/341.13, DIG. 38, DIG. 56

[56] References Cited

U.S. PATENT DOCUMENTS

| | | | |
|---|---|---|---|
| 2,217,892 | 10/1940 | Dodge | 292/341.12 |
| 3,206,240 | 9/1965 | Roethel | 292/216 |
| 4,165,112 | 8/1979 | Kleefeldt | 292/DIG. 40 X |

FOREIGN PATENT DOCUMENTS

| | | |
|---|---|---|
| 3150621 | 6/1983 | Fed. Rep. of Germany . |
| 2725345 | 5/1985 | Fed. Rep. of Germany . |

*Primary Examiner*—Richard E. Moore

*Attorney, Agent, or Firm*—Karl F. Ross; Herbert Dubno

[57] ABSTRACT

A keeper according to the invention is used in combination with a motor-vehicle door post and with a latch fork displaceable in an inward direction toward and an outward direction away from the post on closing and opening of the respective door. The keeper has a U-section sheet-metal frame having flanges secured to the door post and formed with a throughgoing passage open transversely of the directions and having relative to the directions an outer edge. An incompressible but elastomeric damper insert received in the frame has a throughgoing passage aligned with that of the frame, engages inward and outward laterally past the frame, and is formed with a groove opening inward at the outer frame-passage edge. A hard metallic abutment of mushroom section has a central outwardly flared stem snugly received in the groove and tabs outwardly overreaching and overlying the outer frame-passage edge and defining an inwardly convex surface. The fork has an arm engaging through the aligned passages and having an outwardly concave surface engaging outward against the surface of the abutment in a closed and latched position of the door. The stem and groove are so dimensioned that the abutment is elastically prestressed outward against the outer frame-passage edge.

7 Claims, 4 Drawing Figures

KEEPER FOR VEHICLE DOOR LATCH AND METHOD OF MAKING SAME

FIELD OF THE INVENTION

The present invention relates to a keeper for a motor-vehicle door latch. More particularly this invention concerns such a keeper and a method of making same for such a latch having a pivotal latching fork.

BACKGROUND OF THE INVENTION

A standard motor-vehicle door latch has a keeper on the door post and a latching bolt on the door. The latching bolt is typically a fork pivotal about a horizontal axis in the plane of the door and having a pair of arms forming a radially open notch. The keeper is basically a structure forming an eye or vertically open hole into which the innermost of the two fork arms engages when the door is shut. Unlike the fork which pivots on the door, the keeper is essentially fixed on and does not move relative to the door post it is mounted on. When the latch fork is engaged through the keeper, the door is held shut by the outer surface of the inner arm of the fork. The outer arm of the fork serves principally to actuate and pivot in the inner arm as the door closes.

Clearly, therefore, the outer edge of the hole in the keeper through which the fork arm engages is subject to considerable wear. Accordingly it is known from German Pat. No. 2,725,345 to form the keeper as a U-shaped sheet metal body formed by a pair of sides joined at one end by a bight concave away from the door and having at their opposite ends outwardly directed flanges bolted to the door post. This keeper frame houses an elastomeric bumper insert having end flanges that engage past the ends of the frame to hold this insert in place. Both the frame and the insert define the normally vertically open passage through which the inner fork arm engages to hold the door shut.

In order to hold the door tight the elastomeric insert is formed with a head projecting into the eye and engaging over the outer edges of the hole in the frame, so that the fork actually bears on this enlarged unitary head of the insert rather than on the frame. The deformation of this compressible body therefore provides the cushion that keeps the door tight in its opening and prevents it from rattling.

Obviously, however, this part of the insert is subject to considerable stress and deformation, which is even worse in systems with servo-controlled door latches such as described in German patent document No. 3,150,621 or in arrangements where the door handle is pushed to unlock the door. Thus the insert can wear out rather rapidly so that the respective door will not sit tight in its opening. Repair of the part is normally fairly difficult, so that the entire part is simply replaced.

OBJECTS OF THE INVENTION

It is therefore an object of the present invention to provide an improved keeper for a motor-vehicle door latch.

Another object is the provision of such a keeper for a motor-vehicle door latch which overcomes the above-given disadvantages, that is which has a long service life, even when used with a motor-powered door latch.

A further object is to provide an improved method of making a motor-vehicle door-latch keeper.

SUMMARY OF THE INVENTION

A keeper according to the invention is used in combination with a motor-vehicle door post and with a latch fork displaceable in an inward direction toward and an outward direction away from the post on closing and opening of the respective door. The keeper has a U-section sheet-metal frame having flanges secured to the door post and formed with a throughgoing passage open transversely of the directions and having relative to the directions an outer edge. An incompressible but elastomeric damper insert received in the frame has a throughgoing passage aligned with that of the frame, engages inward and outward laterally past the frame, and is formed with a groove opening inward at the outer frame-passage edge. A hard metallic abutment of mushroom section has a central outwardly flared stem snugly received in the groove and tabs outwardly overreaching and overlying the outer frame-passage edge and defining an inwardly convex surface. The fork has an arm engaging through the aligned passages and having an outwardly concave surface engaging outward against the surface of the abutment in a closed and latched position of the door. The stem and groove are so dimensioned that the abutment is elastically prestressed outward against the outer frame-passage edge.

Thus with the system of this invention an elastomerically mounted metallic abutment takes the brunt of the force of opening and closing. Thus wear is minimized while the advantages of a damper insert in the keeper frame are retained.

According to a feature of this invention the frame tapers outward and has outwardly tapering inner surfaces compressing the insert at the groove and thereby elastically urging the stem outward. Thus any force pulling the abutment out of the groove will only tighten the grip of the insert on the abutment stem.

The abutment of this invention is of high-strength or hardened steel. It can be forged or a precision casting. Thus it need not be machined.

For ease of assembly the insert is formed with a recess of the same section as the abutment and open away from the flanges and the frame is formed at the flanges with at least one cutout through which the abutment can pass.

The keeper is assembled and installed according to this invention by first inserting the abutment into the recess in the insert, then inserting the insert and abutment together into the frame with the insert passing through the cutout, and finally securing the flanges to the door post. No fancy tools are needed. In fact the entire assembly can be taken apart by hand once it is removed from the door post.

DESCRIPTION OF THE DRAWING

The above and other features and advantages will become more readily apparent from the following, reference being made to the accompanying drawing in which.

SPECIFIC DESCRIPTION

Figure 1:
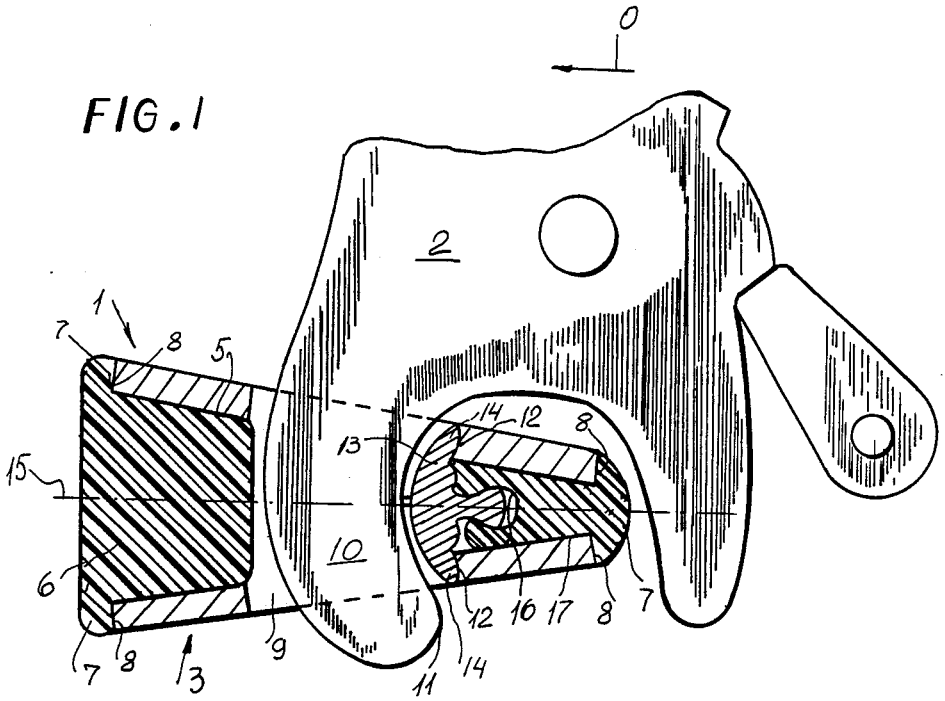
FIG. 1 is a side partly sectional view through a keeper and latching fork according to this invention.
Figure 2:
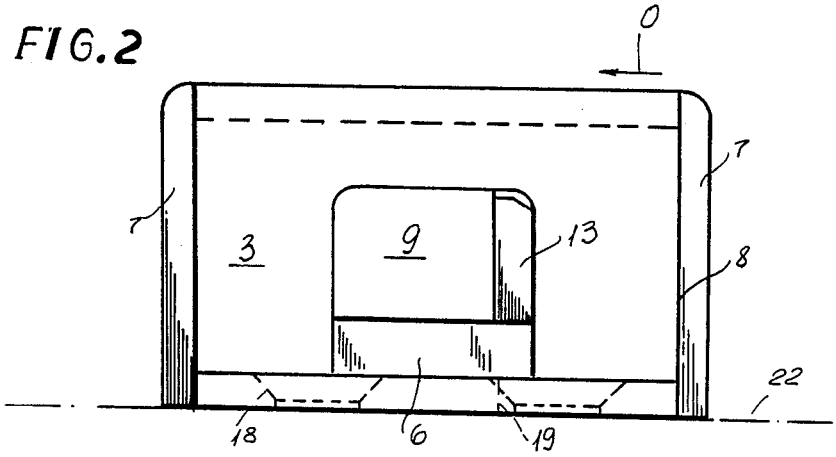
FIG. 2 is a top view of the assembled keeper of the present invention.

As seen in FIGS. 1 and 2 the latch assembly according to the invention comprises a keeper 1 mounted on a door post whose surface is illustrated at 22 in FIG. 1 and a latching fork 2 which is pivoted on the corresponding door edge and which normally moves in an inward direction D to engage in the keeper 1. This structure is standard and is described in above-cited German patent document Nos. 2,725,345 and 3,150,621.

The keeper 1 itself is formed by a U- or omega-shaped sheet-metal frame 3 having opposite end surfaces 8 and two flanges 4 extending vertically oppositely from the legs or sides of the frame 3. These flanges 4 are formed with bores 18 permitting the frame 3 to be bolted to the post 22. In addition this frame 3 is tapered or wedge-shaped opposite to the direction D, that is against the inward direction D the vehicle door and fork 2 move in as the door closes.

Inside the frame 8 is a cushion or insert body 6 of an elastically deformable but substantially incompressible rubber or synthetic resin. This body 6, which fits inside the frame 3 and is therefore identically tapered, has end flanges or rims 7 that project transversely to the direction D past and engage flatly against the end surfaces 8 so that these rims 7 anchor the body 6 longitudinally in the frame 3. In addition the frame 3 and body 6 are formed with respective passages 20 and 21 that together form a throughgoing hole 9 through which engages the inner arm 10 of the form 2, which arm 10 has a curved surface 11 concave against the direction D. The passage 20 extends all the way through the flanges 4 so that the hole 9 is actually defined on its side at the door post only by the part 6.

The keeper 1 is further provided with a forged-steel abutment 13 which is generally of mushroom-section, having a rib or central stem part 15 and a pair of tabs 14. The rib 15 is tightly engaged in a complementary groove 16 of the body 6 and the tabs 14 engage flatly against outer edges 12 of the frame 3 in the hole 9. This abutment 13 therefore engages the surface 11 of the latching fork 2 with a part-cylindrical surface so that the fork 2 does not directly contact either the frame 3 or the body 6. The rib 15 is of increasing thickness away from the tabs 14 and the groove 16 is complementarily shaped so that the tabs 14 are prestressed against the surfaces 14.

Such an arrangement therefore protects the location subjected to the most stress with a hard steel insert. The cushioning of the elastomeric body 6 is not lost, however, since there is still some capability of movement of the abutment 13 in the frame 3. A long service life is assured even when the system is used with motor-operated door latches.

Figure 3:
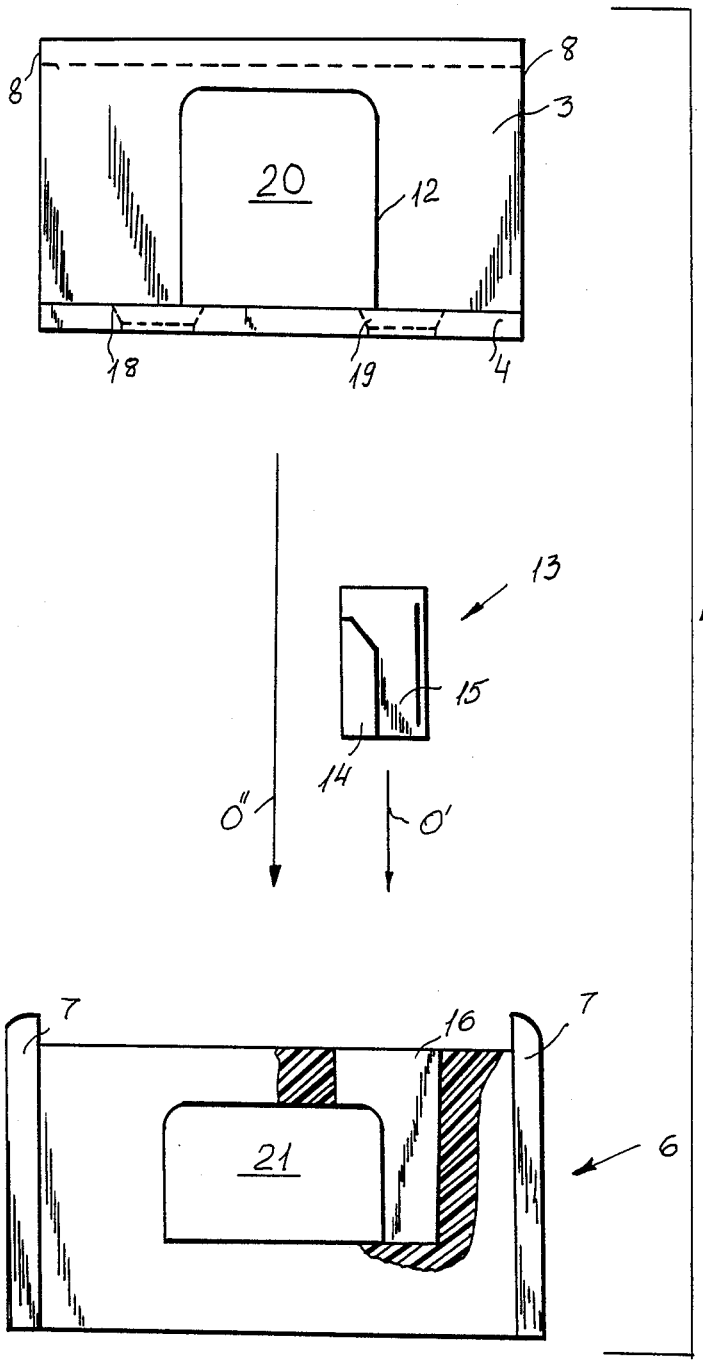
FIGS. 3 and 4 are top and end exploded views of the keeper illustrating its assembly.
Figure 4:
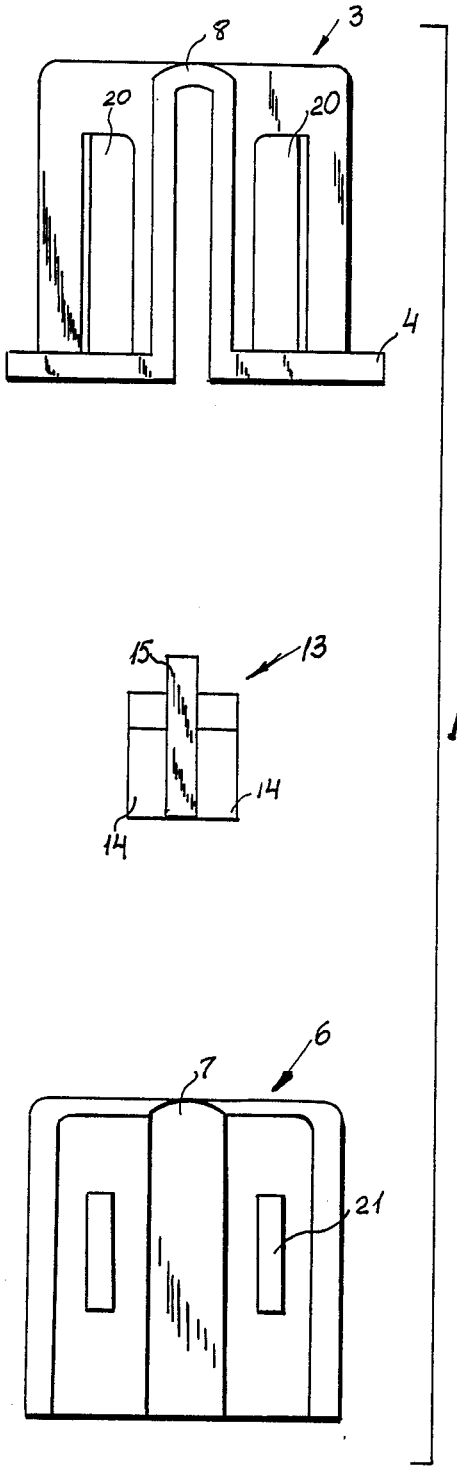

FIGS. 3 and 4 illustrate how the system of this invention is assembled.

First of all the abutment 13 is pushed in transverse direction D' which is from the narrow to the side side of the tapered block 6 into a complementary mushroom-section recess 16 formed in this body 6 and open at its narrow edge. Although open laterally, the recess 16 is otherwise blind, that is has a floor level with the side of the opening 21 closest to the post so that when thus inserted the abutment 13 is perfectly positioned and can only move opposite the direction D'.

Then the frame is pushed in direction D" parallel to the direction 3' over the subassembly of body 6 and abutment 13. To pass the tabs 14 of the abutment 13 the wide edges and flanges 4 of the frame 3 are formed with notches 19. When the assembly is fitted fully together the closed bight of the U-section frame 3 effectively locks the abutment 13 in the recess 16.

Bolting the finished assembly to the door finishes the assembling operation and ensures that the part 6 cannot move in the direction D" out of the frame 3.

Clearly this is an extremely simple way to fabricate this part, one that can readily be adapted to current production techniques. In addition it makes it fairly easy to replace the body 6 and/or the abutment 13 since once the keeper 1 is off the door post 22 it can be disassembled completely without the use of tools.

We claim:

1. In combination with a motor-vehicle door post and with a latch fork displaceable in an inward direction toward and an outward direction away from the post on closing and opening of the respective door, a keeper comprising:

a U-section sheet-metal frame having flanges secured to the door post and formed with a throughgoing passage open transversely of the directions and having relative to the directions an outer edge;

an incompressible but elastomeric damper insert received in the frame, having a throughgoing passage aligned with that of the frame, engaging inward and outward laterally past the frame, and formed with a groove opening inward at the outer frame-passage edge; and a hard metallic abutment of mushroom section having a central outwardly flared stem snugly received in the groove and tabs outwardly overreaching and overlying the outer frame-passage edge and defining an inwardly convex surface, the fork having an arm engaging through the aligned passages and having an outwardly concave surface engaging outward against the surface of the abutment in a closed and latched position of the door, the stem and groove being so dimensioned that the abutment is elastically prestressed outward against the outer frame-passage edge.

2. The latch keeper defined in claim 1 wherein the frame tapers outward and has outwardly tapering inner surfaces compressing the insert at the groove and thereby elastically urging the stem outward.

3. The latch keeper defined in claim 1 wherein the abutment is forged.

4. The latch keeper defined in claim 1 wherein the abutment is a precision casting.

5. The latch keeper defined in claim 1 wherein the insert is formed with a recess of the same section as the abutment and open away from the flanges.

6. The latch keeper defined in claim 1 wherein the frame is formed at the flanges with at least one cutout through which the abutment can pass.

7. A method of assembling and installing a keeper on a motor-vehicle door post for cooperation with a latch fork displaceable in an inward direction toward and an outward direction away from the post on closing and opening of the respective door, the keeper comprising:

a U-section sheet-metal frame having flanges secured to the door post and formed with a throughgoing passage open transversely of the directions and having relative to the directions an outer edge;

an incompressible but elastomeric damper insert received in the frame, having a throughgoing passage aligned with that of the frame, engaging inward and outward laterally past the frame, and formed with a groove opening inward at the outer frame-passage edge; and a hard metallic abutment of mushroom section having a central outwardly flared stem snugly received in the groove and tabs outwardly overreaching and overlying the outer frame-passage edge and defining an inwardly convex surface, the fork having an arm engaging through the aligned passages and having an outwardly concave surface engaging outward against the surface of the abutment in a closed and latched position of the door, the stem and groove being so dimensioned that the abutment is elastically prestressed outward against the outer frame-passage edge, the frame being formed at the flanges with at least one cutout through which the abutment can pass and the insert being formed with a recess of the same section as the abutment and open away from the flanges; the method comprising the steps of sequentially:

inserting the abutment into the recess in the insert;

inserting the insert and abutment together into the frame with the insert passing through the cutout; and securing the flanges to the door post.

* * * * *